US007144267B1

(12) United States Patent
Huang et al.

(10) Patent No.: US 7,144,267 B1
(45) Date of Patent: Dec. 5, 2006

(54) ELECTRICAL CONNECTOR WITH LATCH MECHANISM

(75) Inventors: Mao-Jung Huang, Tucheng (TW); Te-Hung Yin, Tucheng (TW); Ping-Chih Chen, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/411,755

(22) Filed: Apr. 27, 2006

(30) Foreign Application Priority Data

Jul. 8, 2005 (TW) ..... 94211625 U

(51) Int. Cl.
*H01R 13/627* (2006.01)

(52) U.S. Cl. ..... 439/352

(58) Field of Classification Search ..... 439/353, 439/350, 351, 354, 355, 345–346
See application file for complete search history.

(56) References Cited

U.S. PATENT DOCUMENTS 2,895,119 A * 7/1959 Montgomery, Jr. ..... 439/354
5,011,424 A * 4/1991 Simmons ..... 439/352
5,154,629 A * 10/1992 Carver et al. ..... 439/352
5,158,473 A * 10/1992 Takahashi et al. ..... 439/353
5,449,298 A * 9/1995 Fetterolf et al. ..... 439/352
7,074,070 B1 * 7/2006 Huang et al. ..... 439/352
2006/0141843 A1 * 6/2006 Huang et al. ..... 439/350

FOREIGN PATENT DOCUMENTS

GB 2183934 A * 6/1987

* cited by examiner

*Primary Examiner*—Hae Moon Hyeon
(74) *Attorney, Agent, or Firm*—Rosenberg, Klein & Lee

(57) ABSTRACT

An electrical connector with latch mechanism includes an insulating housing having at least two rows of contact receiving channels and a passageway defined between the two rows of contact receiving channels, a plurality of contacts received in the contact receiving channels, and a latch mechanism mounted in the passageway including a pair of latch arms and a flexible beam flexibly connecting the latch arms. The pair of latch arms has a pair of hooks and a pair of force receiving portions forming a pair of cantilevers at outer sides thereof and a pair of flexible slices at inner sides thereof extending inwardly toward each other. During the force receiving portions are exerted to make the hooks latch a mating electrical connector, besides the flexible beam, the cantilevers and the flexible slices are deformed to cumulate resilience which produces an increased latch force when the force receiving portions are released.

3 Claims, 4 Drawing Sheets

ELECTRICAL CONNECTOR WITH LATCH MECHANISM

BACKGROUND OF THE INVENTION

1. Field of the Invention

The present invention generally relates to an electrical connector, and more specifically to an electrical connector having a latch mechanism for connecting and releasably locking the electrical connector to a mating electrical connector.

2. The Related Art

Electrical connectors are widely applied in electrical connection systems. A reliable connection between a pair of mated electrical connectors is crucial to the system; otherwise electrical interruption may be frequently caused. To obtain a reliable connection, more and more connectors are designed to have a latch mechanism.

U.S. Pat. No. 5,154,629 issued on Oct. 13 in 1992 describes an electrical connector with a pair of latch mechanisms. The electrical connector disclosed in the patent includes a cable coupled to an electrical connector housing, which is enclosed by a molded outer housing. The outer housing has a pair of side cavities pivotally receiving a pair of latch mechanisms. The latch mechanisms have locking fingers for engaging a connecting element and are biased into a locking position by integral leaf spring or helical compression springs. The pivotal coupling of the latch mechanisms is accomplished by protrusions on the latch mechanisms retained by recessed in the housing, a pin assembly, or an integrally molded hinge.

However, the latch mechanisms mentioned above are arranged on two opposite sides of the electrical connector, which occupy additional space. Furthermore, the side cavities of the outer housing should have enough space for pivoting the latch mechanisms between open and closed positions. Therefore the width of the electrical connector is increased.

SUMMARY OF THE INVENTION

The present invention is directed to solving the above problems and provides an electrical connector with latch mechanism. The electrical connector with latch mechanism includes an insulating housing which has at least two rows of contact receiving channels extending therethrough and a passageway defined between the two rows of contact receiving channels, a plurality of contacts received in the respective contact receiving channels, and a latch mechanism mounted in the passageway including a pair of latch arms and a flexible beam flexibly connecting the pair of latch arms. The pair of latch arms has a pair of hooks at front ends thereof and a pair of force receiving portions at rear ends thereof. The pair of force receiving portions forms a pair of cantilevers at outer sides thereof and a pair of flexible slices at inner sides thereof extending inwardly toward each other. During the force receiving portions are exerted to make the hooks latch a mating electrical connector, besides the flexible beam, the cantilevers and the flexible slices are deformed to cumulate resilience which produces an increased latch force when the force receiving portions are released.

In the electrical connector mentioned-above, the latch mechanism is assembled in inner space of the insulating housing. Consequently, the electrical connector with latch mechanism of the present invention can make the most of the inner space to achieve a compact width. Furthermore, the cantilevers and the flexible slices increase the latch force to make the hooks latch the mating connector, therefore a reliable connection between the present electrical connector and the mating connector is achieved.

Other objects, advantages and novel features of the present invention will become more apparent from the following detailed description of a preferred embodiment thereof when taken in conjunction with the accompanying drawings.

DETAILED DESCRIPTION OF THE PREFERRED EMBODIMENT

In order to illustrate the present invention particularly, including technology, structure trait, aims and efficiency, a detailed explanation of a preferred embodiment of the present invention will be given thereinafter, with reference to the attached drawings, for better understanding thereof to those skilled in the art.

Figure 1:
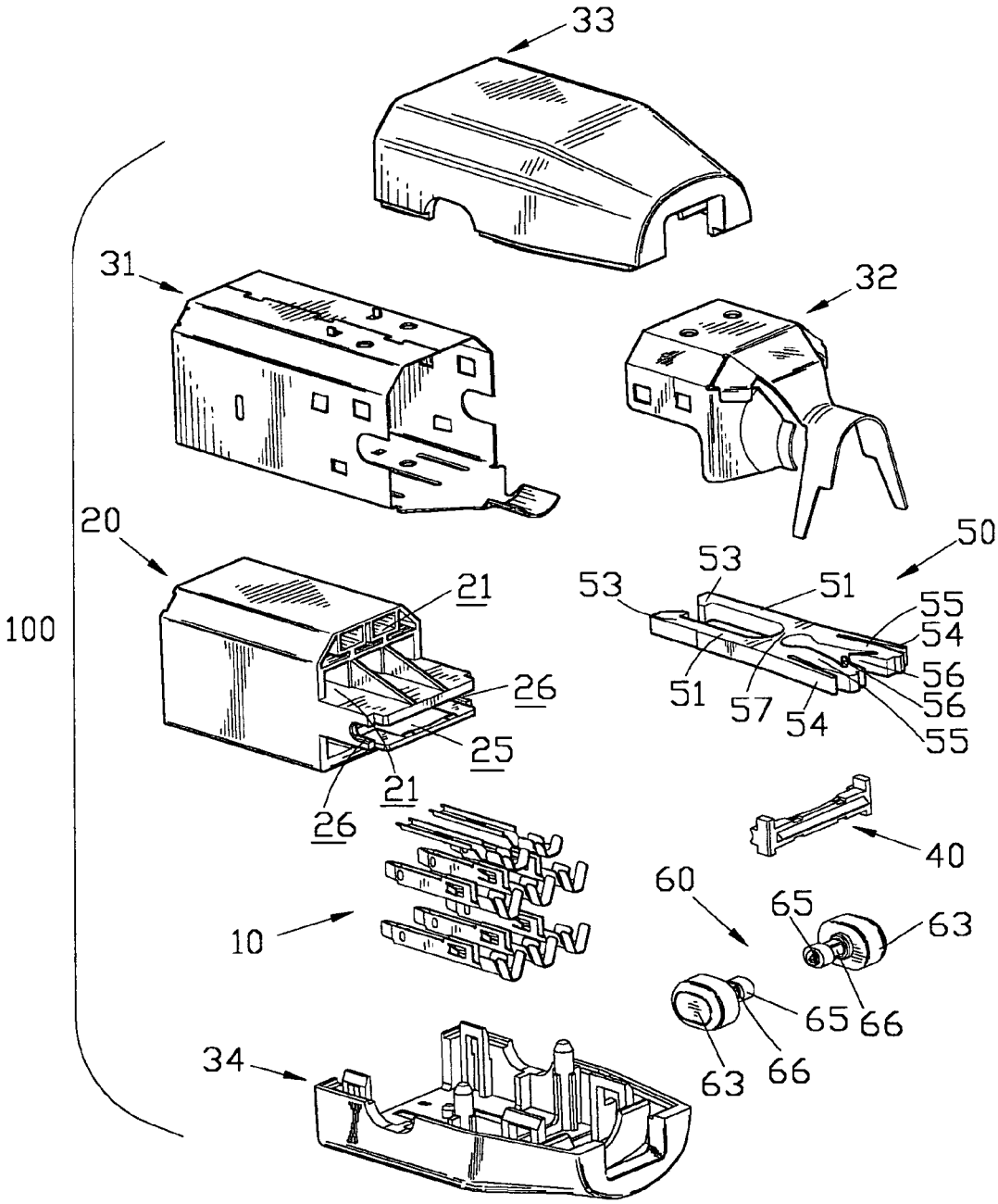
FIG. 1 is an exploded view of an electrical connector with latch mechanism in accordance with the present invention.

Referring to FIG. 1, an electrical connector 100 in accordance with the present invention comprises an insulating housing 20, a plurality of contacts 10 and a latch mechanism 50 received in the insulating housing 20, a primary metal shield 31 and a second metal shield 32 encircling the insulating housing 20, and an upper dielectric cover 33 and a lower dielectric cover 34 buckling the insulating housing 20.

Figure 2:
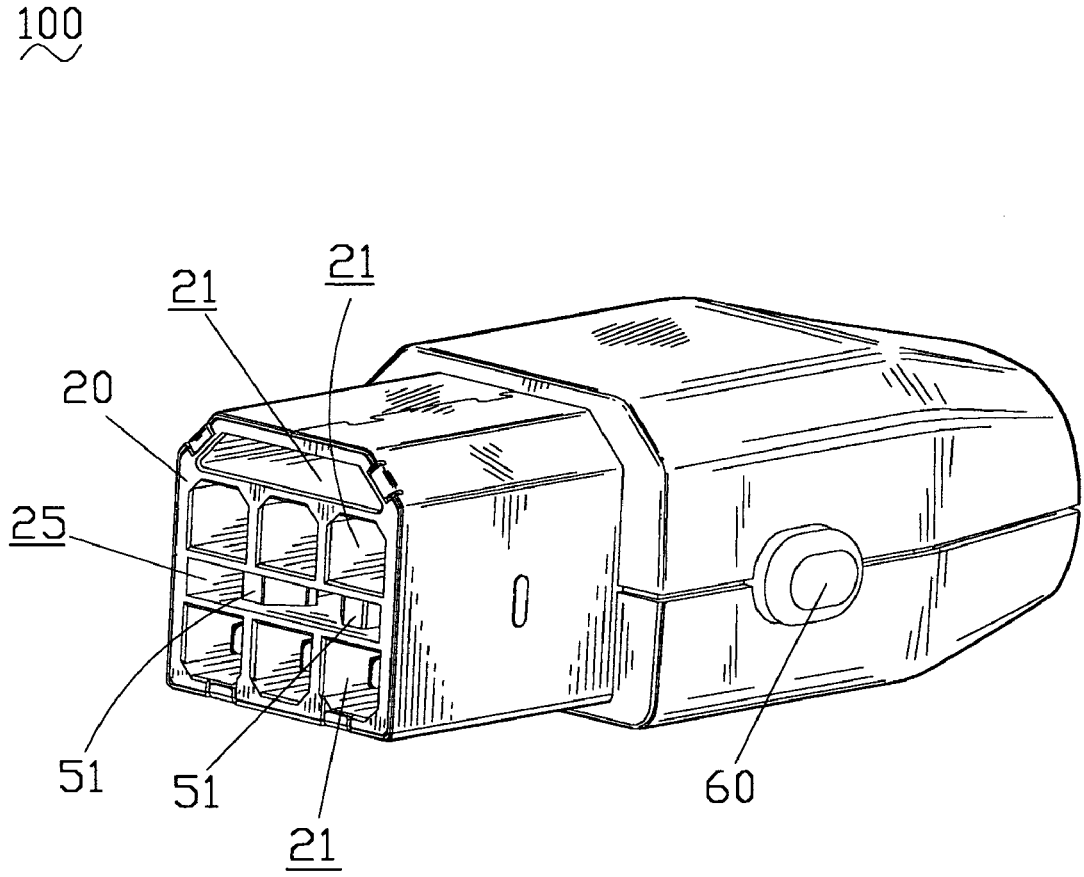
FIG. 2 is a perspective view of the electrical connector with latch mechanism shown in FIG. 1.

Referring to FIG. 2 in conjunction with FIG. 1, the insulating housing 20 defines a plurality of contact receiving channels 21 and a passageway 25 therein, which extend through the insulating housing 20 front to rear. The contact receiving channels 21 are arranged in three (upper, middle, and lower) rows for respectively holding three (upper, middle, and lower) rows of contacts 10 therein. The passageway 25 is defined between the middle row and the lower row of the contact receiving channels 21 for receiving the latch mechanism 50. The insulating housing 20 further defines two positioning recesses 26 in lateral sides thereof, and each positioning recess 26 communicates with the passageway 25 and has a rear opening.

Figure 4:
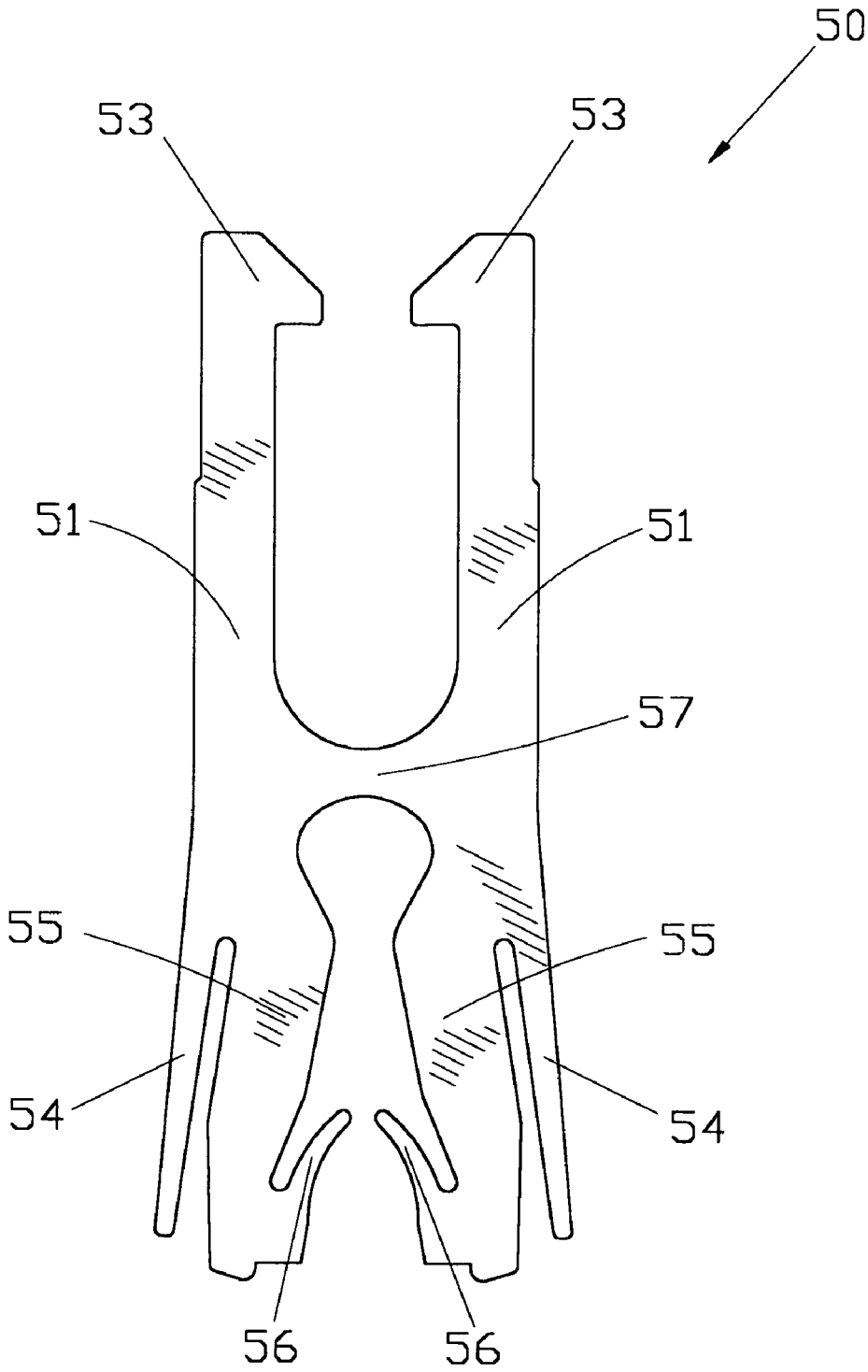
FIG. 4 is a perspective view of the latch mechanism of the electrical connector in accordance with the present invention.

The latch mechanism 50 shown in FIG. 4 is fabricated of unitarily single component of dielectric material, such as plastic or the like. The latch mechanism 50 includes a pair of latch arms 51, and a flexible beam 57 flexibly connecting the middle portion of the pair of latch arms 51. The pair of latch arms 51 has a pair of hooks 53 protruding inwardly at front ends thereof, and a pair of force receiving portions 55 at rear ends thereof. The pair of force receiving portions 55 form a pair of cantilevers 54 at outer sides thereof and a pair of flexible slices 56 at inner sides thereof extending inwardly toward each other.

The latch mechanism 50 is used for releasably locking the electrical connector 100 to a mating electrical connector. When using, an external force is exerted on the cantilevers 54 to urge the cantilevers 54 to move inwardly and lean against the force receiving portions 55, then the external force is sent to the force receiving portions 55 which make the hooks 53 latch a mating electrical connector. In the meantime, the flexible slices 56 are deformed and pressed close to each other for cumulating resilience which urges the flexible slices 56 to recover their original position. In this course, the latch force is increased when the force receiving portions 55 are released.

Please refer to FIG. 1 again. The electrical connector 100 further includes a pair of buttons 60 and a stopper 40. Each of the buttons 60 has a pressing head 63, a pushing foot 65, and a propping neck 66 connecting the pressing head 63 and the pushing foot 65 together.

Figure 3:
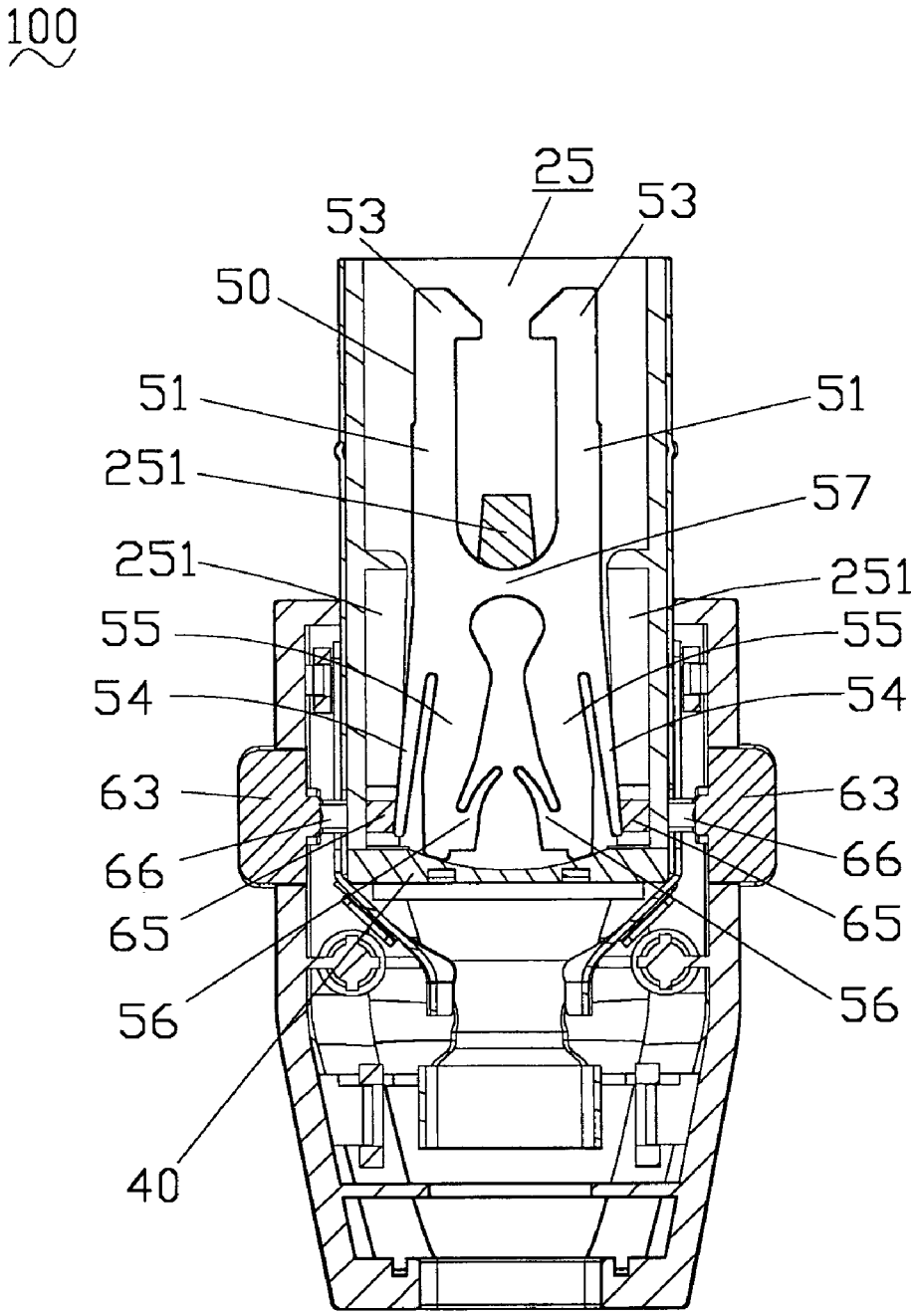
FIG. 3 is a cross-sectional view of the electrical connector with latch mechanism.

Please refer to FIG. 3 now. In assembling of the electrical connector 100, firstly the contacts 10 are inserted into the insulating housing 20 and held in the receiving channels 21. Then the latch mechanism 50 is mounted in the passageway 25 of the electrical connector 100 and positioned by three protrusions 251 formed in front and lateral sides of the passageway 25 of the electrical connector 100, so that the latch mechanism 50 is fixed in the passageway 25 and formed as an integrated element to stop the latch mechanism 50 from onward, rightward, and leftward movement relative to the insulating housing 20. Thereafter, the propping neck 66 of each buttons 60 is retained in the positioning recess 26 with the pressing head 63 exposed to the outside of the insulating housing 20 and the pushing foot 65 extending into the passageway 25 for touching the cantilever 54 of the latch mechanism 50. The stopper 40 is infixed into the end of the passageway 25 and seals the rear opening of each positioning recess 26 so as to keep the latch arms 51 of the latch mechanism 50 and the buttons 60 from rearward movement. Finally, the insulating housing 20 is covered by the primary metal shield 31 and the secondary metal shield 32, and clasped by the upper dielectric cover 33 and the lower dielectric cover 34.

In the electrical connector 100 in accordance with the present invention, the buttons 60 are used to cooperate with the latch mechanism 50 for transmitting an external force acted on the pressing heads 63 to the cantilever 54 of the latch mechanism 50 by the pushing foot 65 touching with the cantilever 54. As using, when the pressing heads 63 are pressed, the pressing force is transmitted to the cantilever 54 and leans the cantilever 54 against the force receiving portions 55, then the pressing force is sent to the force receiving portions 55, thereby the two latch arms 51 are pivoted on the flexible beam 57. In the meantime, besides the flexible beam 57, the flexible slices 56 are deformed and pressed close to each other for cumulating resilience, which urge the flexible slices 56 to recover their original position. When the external force is removed from the pressing heads 63 of the buttons 60, the hooks 53 urged by the force generated by the elastic arms 51, cantilevers 54, and flexible slices 56 tend to recover to their original positions, thereby make the hooks 53 latch a mating connector.

It can be seen from the mentioned-above that the latch mechanism 50 is assembled in inner space of the insulating housing 20. Consequently, the electrical connector 100 can make the most of the inner space to achieve a compact width. Furthermore, the cantilevers 54 and the flexible slices 56 increase the latch force to make the hooks 53 latch the mating connector, therefore a reliable connection between the electrical connector 100 and a mating connector is achieved.

Although a preferred embodiment of the present invention has been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. An electrical connector with latch mechanism comprising:

an insulating housing having at least two rows of contact receiving channels extending therethrough and a passageway defined between the two rows of contact receiving channels;

a plurality of contacts received in the respective contact receiving channels; and a latch mechanism mounted in said passageway, the latch mechanism including a pair of latch arms and a flexible beam flexibly connecting the pair of latch arms, the pair of latch arms having a pair of hooks at front ends thereof and a pair of force receiving portions at rear ends thereof, the pair of force receiving portions forming a pair of cantilevers at outer sides thereof and a pair of flexible slices at inner sides thereof extending inwardly toward each other;

whereby during the force receiving portions are exerted to make the hooks latch a mating electrical connector, besides the flexible beam, the cantilevers and the flexible slices are deformed to cumulate resilience which produces an increased latch force when the force receiving portions are released.

2. The electrical connector with latch mechanism as claimed in claim 1, wherein said insulating housing defines two positioning recesses in opposite sides thereof communicating with said passageway, the electrical connector with latch mechanism further includes two buttons mounted on said insulating housing, each button has a pressing head exposed to outside of said insulating housing, a pushing foot extending into said passageway for touching the corresponding cantilever of the latch arm, and a propping neck retained in the corresponding recess, said force receiving portion is exerted by pressing the pressing head.

3. The electrical connector with latch mechanism as claimed in claim 2, further including a stopper infixed in the end of said passageway and sealing rear openings of said recesses for retaining said latch arms and said buttons.

* * * * *